US005884345A

United States Patent [19]

Sugiyama et al.

[11] Patent Number: 5,884,345

[45] Date of Patent: Mar. 23, 1999

[54] SANITARY DEVICE

[75] Inventors: Yuji Sugiyama; Toshiyuki Torii, both of Kariya, Japan

[73] Assignee: Aisin Seiki Kabushiki Kaisha, Kariya, Japan

[21] Appl. No.: 865,697

[22] Filed: May 30, 1997

[30] Foreign Application Priority Data

May 30, 1996 [JP] Japan ..... 8-136877

[51] Int. Cl.[6] ..... A47K 3/22

[52] U.S. Cl. ..... 4/443; 4/420.4; 4/447

[58] Field of Search ..... 4/443, 444, 445, 4/446, 447, 448, 420.1, 420.2, 420.3, 420.4, 420.5; 137/625.15; 251/208

[56] References Cited

U.S. PATENT DOCUMENTS

| | | | |
|---|---|---|---|
| 4,597,111 | 7/1986 | Hirashiba et al. | 4/420.4 |
| 4,962,912 | 10/1990 | Stoll | 251/208 |
| 5,542,133 | 8/1996 | Makino et al. | 4/420.4 |

FOREIGN PATENT DOCUMENTS

| | | | |
|---|---|---|---|
| 406010393 | 1/1994 | Japan | 4/448 |
| 6-88370 | 3/1994 | Japan . | |

*Primary Examiner*—David J. Walczak

*Attorney, Agent, or Firm*—Oblon, Spivak, McClelland, Maier & Neustadt, P.C.

[57] ABSTRACT

A sanitary device for washing private parts of a person sitting on a toilet bowl includes a first nozzle positioned within the toilet bowl and having a main passage and an auxiliary passage. The main passage has at least one main aperture and the auxiliary passage has at least one auxiliary aperture, the main and auxiliary apertures being located at a distal end of the first nozzle and being directed to a private part of a person sitting on the toilet bowl. A second nozzle is positioned within the toilet bowl and has a third passage having at least one third aperture located at a distal end of the second nozzle and being directed to another private part of a person sitting on the toilet bowl. A regulating device is fluidically disposed between a supply of water under pressure and each of the main passage, the auxiliary passage and the third passage for establishing a variable degree of fluid communication between the water supply and at least one of the main, auxiliary and third passages.

3 Claims, 7 Drawing Sheets

SANITARY DEVICE

BACKGROUND OF THE INVENTION

1. Field of the Invention

The present invention relates to a sanitary device and in particular to a sanitary device in which two different water ejecting patterns are obtained.

1. Description of the Related Art

In a conventional device of this kind, for example as disclosed in Japanese Patent Laid Open Print No. Hei 6-88370 published without examination on Mar. 29, 1994, a nozzle is formed with a main passage and an auxiliary passage which terminate at a main aperture and an auxiliary aperture, respectively. The main passage is directly connected to a water supply via a flow regulating valve. The auxiliary passage is in fluid communication with the main passage via a solenoid valve. When an amount of water under a relatively high pressure is desired, the water is supplied to the main passage only by closing the solenoid valve. Conversely, when an amount of water under a relatively low pressure is desired, the water is supplied to the main and the auxiliary passages by opening the solenoid valve. In addition, adjustment of the amount of the water for user comfort is performed by operating a regulation valve. Thus, control of the water is shared by two parts or elements, so that the number of parts is increased and assembly of the device is complex.

SUMMARY OF THE INVENTION

It is therefore a principal object of the present invention is to provide a sanitary device without the foregoing drawbacks.

Another object of the present invention is to provide a sanitary device in which the water amount and the water pressure can be adjusted by a single device.

In order to attain the foregoing objects, a sanitary device for washing a private part of a person sitting on a toilet bowl includes a nozzle positioned within the toilet bowl and having a main passage and an auxiliary passage, the main passage having at least one main aperture and the auxiliary passage having at least one auxiliary aperture, the main and auxiliary apertures being located at a distal end of the nozzle. A regulating device is fluidically disposed between a supply of water under pressure and both the main passage and the auxiliary passage for establishing a variable degree of fluid communication between the water supply and at least one of the main and auxiliary passages.

BRIEF DESCRIPTION OF THE DRAWINGS

The above and other objects, features and advantages of the present invention will be more apparent and more readily appreciated from the following detailed description of a preferred exemplary embodiment of the present invention, taken in connection with the accompanying drawings, in which.

DESCRIPTION OF THE PREFERRED EMBODIMENT

A preferred embodiment of the present invention will be described hereinafter in detail with reference to the accompanying drawings.

Figure 1:
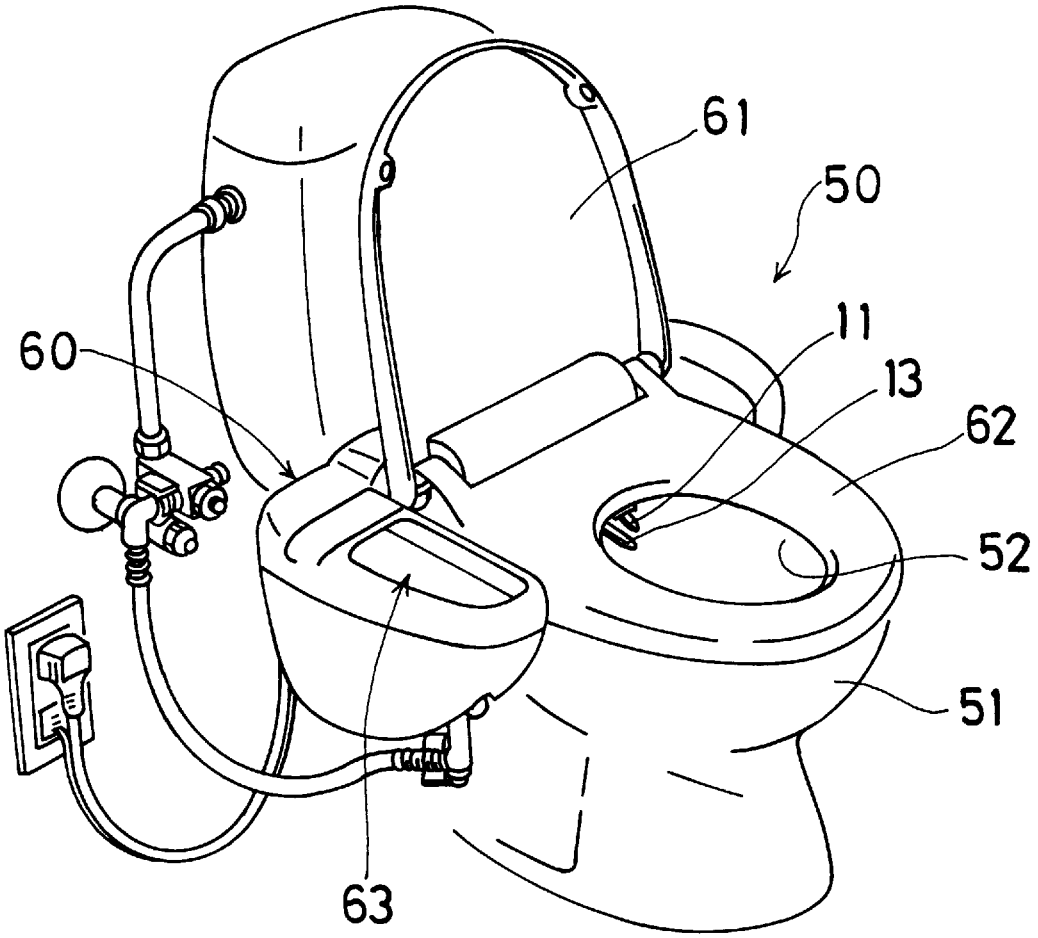
FIG. 1 is a perspective view of a toilet bowl to which a sanitary device according to the present invention is applied.

Referring first to FIG. 1, there is illustrated a solitary device 50 which includes a toilet bowl 51 having therein an inner space 52. On a rear end portion of the toilet bowl 51 there is mounted a casing 60 to which a lid 61 and a seat 62 are pivotally connected. A washing device 10A is accommodated in the casing 60. The washing device 10A, which will be described in detail later, has a first nozzle device 11 and a second nozzle device 13, both of which extend into the inner space 52 of the toilet bowl 51.

Figure 2:
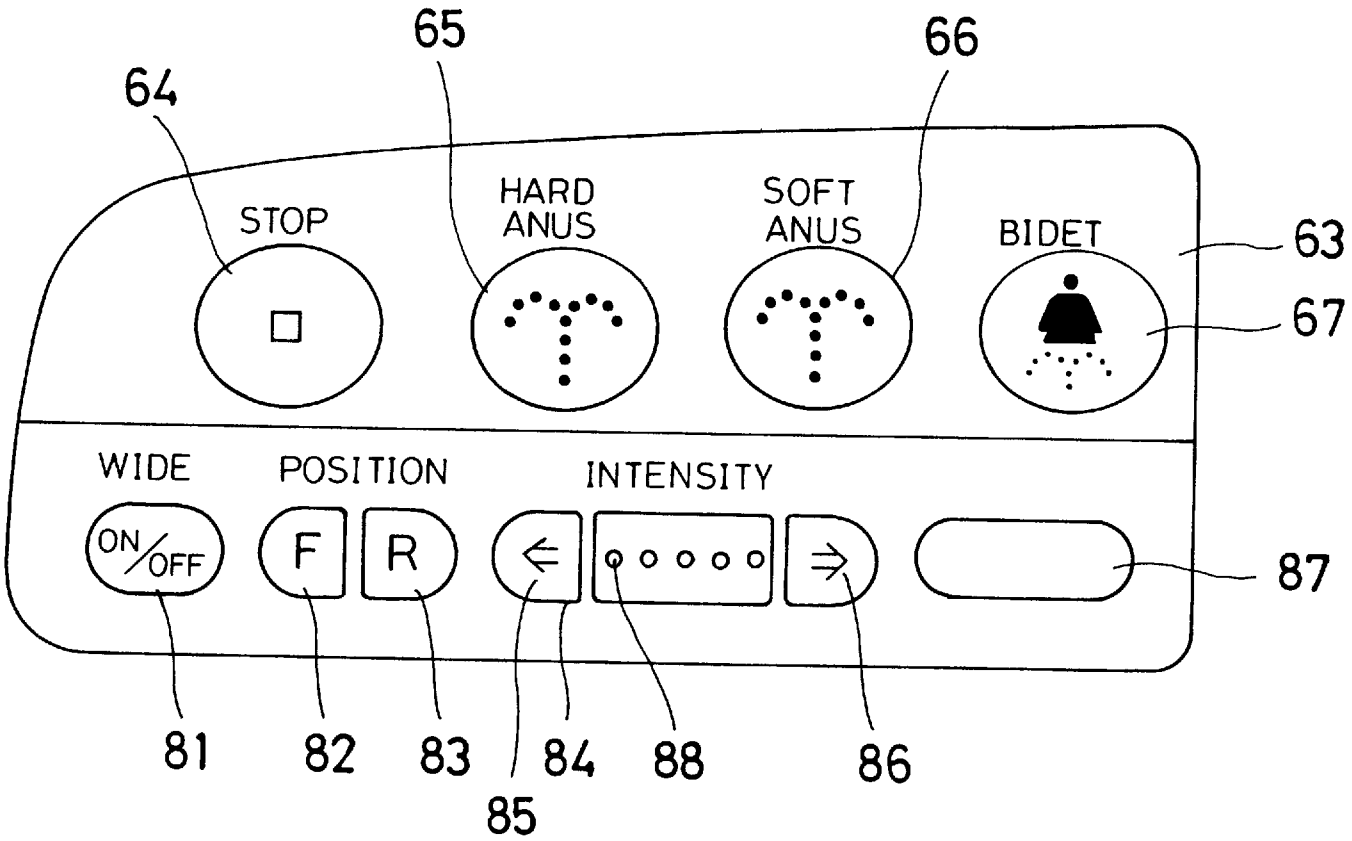
FIG. 2 is an enlarged plain view of an operation panel of the sanitary device.

At the left side surface of the casing 60, as can be seen from FIG. 2, there is provided an operation panel 63 including a stop switch 64, a hard washing switch 65, a soft washing switch 66 and a bidet washing switch 67 arranged in an alignment manner. The operation panel 63 also has a washing range selection switch 81, a front position selection switch 82, a rear position selection switch 83, a pressure decreasing switch 84, a pressure intensity indicator 85 consisting of five lamps 88, a pressure increasing switch 86 and a sensor 87 which are arranged in alignment in parallel with the foregoing alignment. The function of each of the switches 63–67 and the elements 81–87 will become apparent from the later description.

Figure 3:
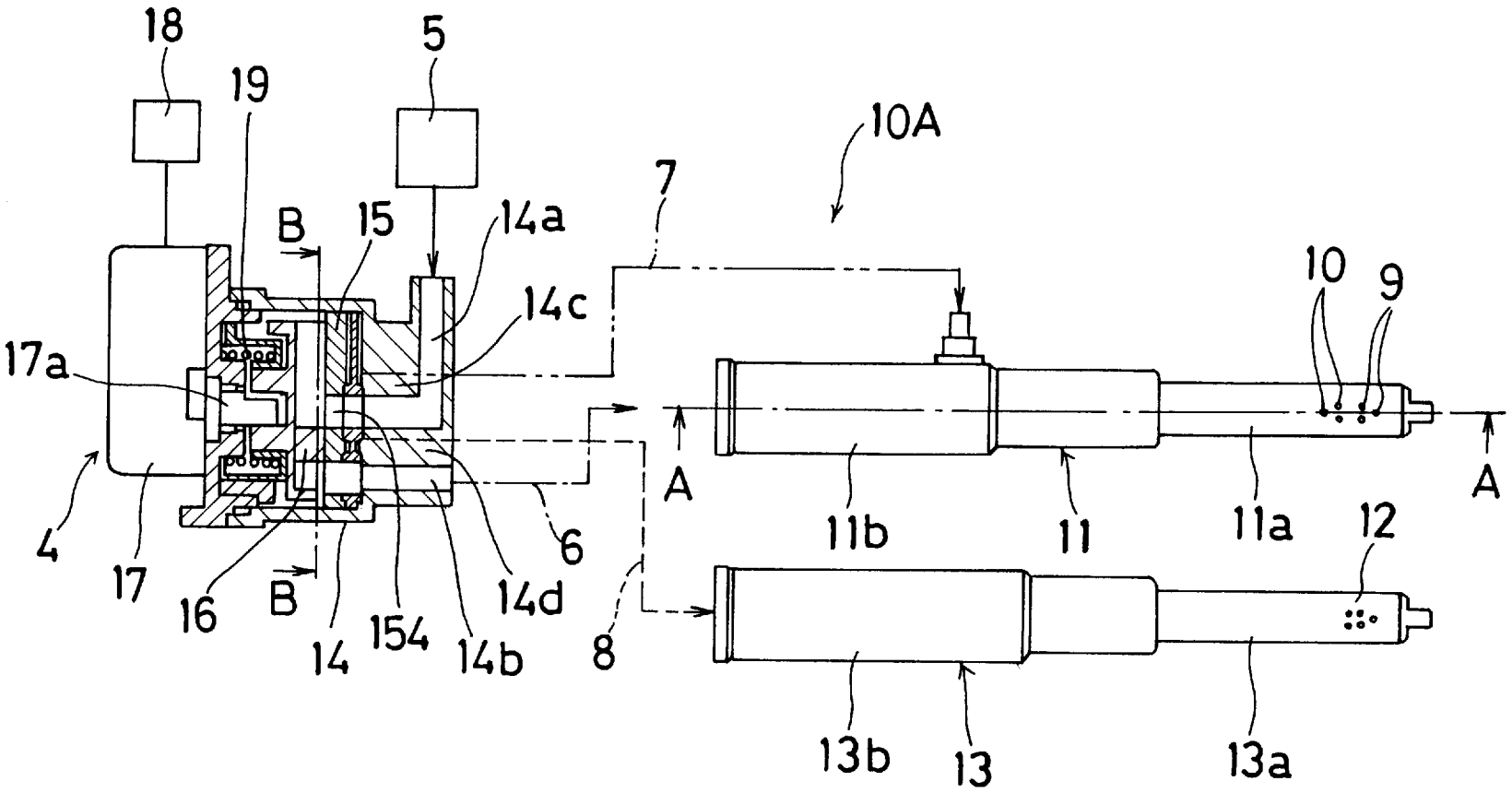
FIG. 3 is a block diagram of a sanitary device according to the present invention.

As shown in FIG. 3, the washing device 10A includes a regulating device 4 which is interposed between a water supply 5 and each of the first nozzle device 11 and the second nozzle device 13. The first nozzle device 11 is designed for washing an anus portion of a person sitting on the seat 62. The second nozzle device 13 is designed for washing genitals.

The latter washing is sometimes called "bidet washing."

Figure 4:
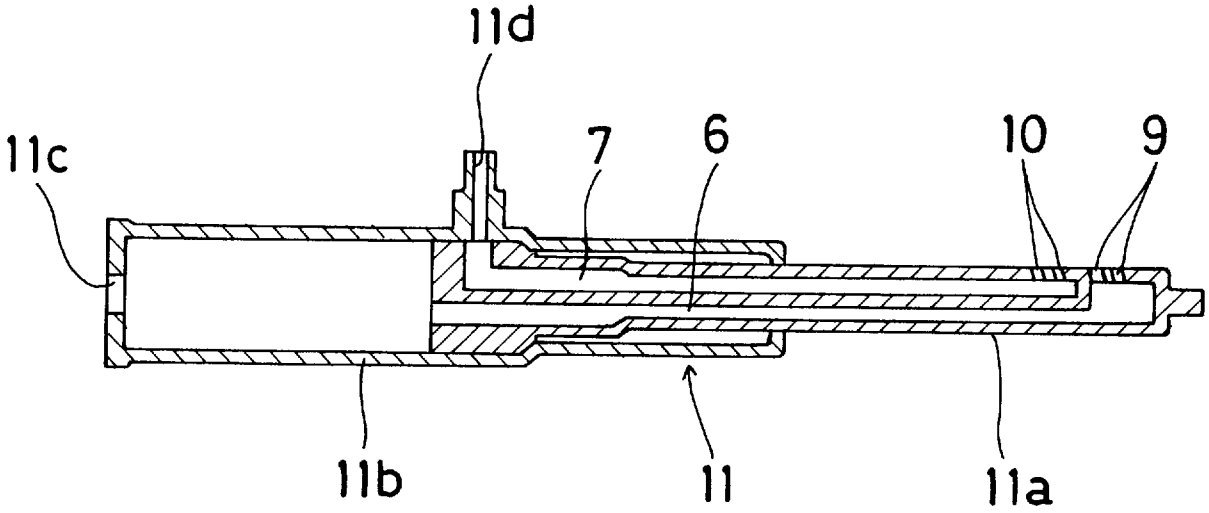
FIG. 4 is a cross-sectional view taken along line A—A in FIG. 3.

The first nozzle device 11, as shown in FIGS. 3 and 4, includes a base portion 11*b* in which an extension nozzle 11*a* is slidably fitted. The extension nozzle 11*a* has main apertures 9 and auxiliary apertures 10 at its distal end portion. A main passage 6 of the extension nozzle 11*a* has the main apertures 9 at its distal end. An auxiliary passage 7 is formed in the extension nozzle 11*a* in parallel with the main passage 6 and has the auxiliary apertures 10 at its distal end. The main passage 6 has a proximal end communicating with a main inlet port 11*c* of the base portion 11*b*. The auxiliary passage 7 has a proximal end which is in alignment with an auxiliary inlet port 11*d* when the extension nozzle 11*a* is fully retracted as shown in FIG. 4.

The second nozzle device 13 is similar to the first nozzle device 11 in construction except that it lacks an auxiliary passage and its related elements.

A driving device (not shown) associated with the base portion 11*b* of the first nozzle device 2 (the base portion 13*b* of the second nozzle device 13) advances the base portion 11*b* a set distance to bring the same to a first position at which the main apertures 9 and the auxiliary apertures 10 aim at the anus and when the switch 65 or 66 is turned on. When the switch 67 is turned on, the driving device advances the base portion 13*b* of the second nozzle device 13 another set distance to bring the same to a second position at which the apertures aim at the pubic portion. Though the detailed construction of such a mechanism is omitted, the first (second) positions can be adjusted somewhat in the advancing and retracting direction using the switches 84 and 86, respectively. In addition, when the switch 81 is turned on while the switch 65 (66) is on, the first nozzle device 11 which is ejecting water toward the anus is caused to reciprocate. The second nozzle device 13 will be caused to reciprocate when the switch 81 is turned on while the switch 67 is on. The foregoing functions can be realized by use of a controller 18 in the form of microprocessor.

Referring back to FIG. 3, the regulating device 4, which is designed to regulate or control an amount of water to be supplied to the first nozzle device 11 (the second nozzle device 13), includes a body or casing 14 including an inlet passage 14*a*, a first outlet passage 14*b*, a second outlet passage 14*c* and a third outlet passage 14*d*. The inlet passage 14*a* is in fluid communication with the water supply 5 in the form a tank (not shown) within the casing 60. The first outlet passage 14*b* and the second outlet passage 14*c* are in fluid communication with the main passage 6 and the auxiliary passage 7, respectively, in the extension nozzle 11*a* of the first nozzle device 11.

A motor 17 controlled by the controller is secured to a left side wall of the body 14 of the regulating device 4 and has a shaft 17*a* which extends into the body 14. Within the body 14, a rotating disk 16 is mounted on the shaft 17*a* of the motor 17 so as to be rotated together with the shaft 17*a* and is movable along the shaft 17*a*. A spring 19 is interposed between the left side wall of the body 14 and a left side of the rotating disk 16. The spring 19 urges the rotating disk 16 rightward along the shaft 17*a*, resulting in the rotating disk 16 coming into engagement with a stationary disk 15 which is secured in the body 14. The rotating disk 16 is in sliding engagement with the stationary disk 15 when the motor 17 is turned on.

Figure 5:
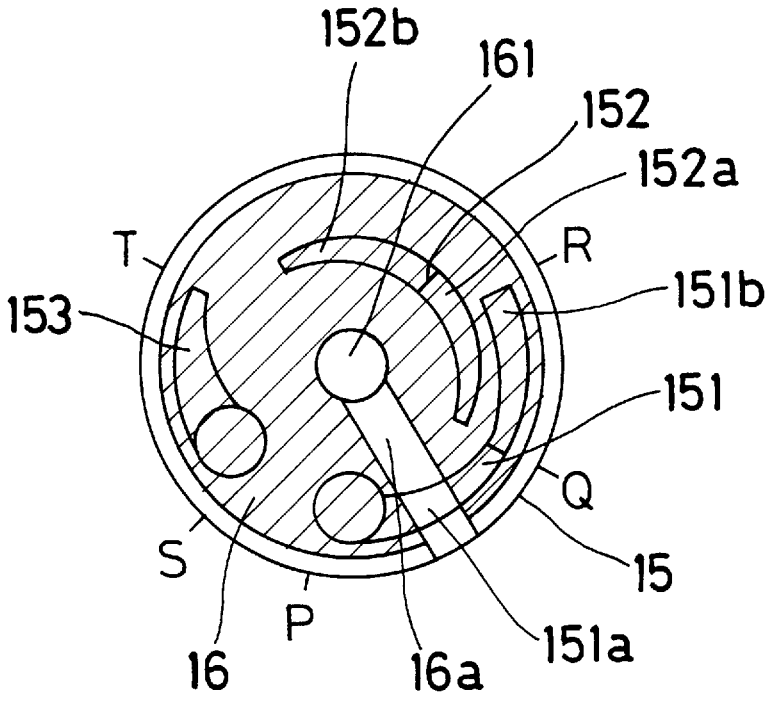
FIG. 5 is a cross-sectional view taken along line B—B in FIG. 3.

As shown in FIG. 5, the stationary disk 15 has formed therein a first slit 151, a second slit 152 and a third slit 153. The first slit 151 includes a first portion 151*a* ranging from an angular position P to an angular position Q in such a manner that the width of the first portion 151*a* is gradually decreased. The first slit 151 also includes a second portion 151*b* connected to the first portion 151*a* at the angular position Q and extending in the counter-clockwise direction to the angular position R. Between the angular positions Q and R, the width of the second portion 151*b* increases gradually.

The second slit 152 has an arc-shaped configuration and has a portion 152*a* positioned radially inside of the second portion 151*b* of the first slit 151 between the angular positions Q and R. Between the angular positions Q and R, the width of the second slit portion 152*a* increases gradually.

The third slit 153 extends in the clockwise direction from an angular position S to an angular position T. Between the angular positions S and T, the width of the third slit 153 gradually decreases.

The rotating disk 16 has a central blind bore 161 and a radial slit 16*a* which extends radially outward therefrom.

The first slot 151 is in fluid communication with the main passage 6 via the passage 14*b*. The second slot 152 is in fluid communication with the passage 7 via the passage 14*c*. The third slot 153 is in fluid communication with the passage 8. The stationary disk 15 has a central bore 154 which establishes a continuous fluid communication between the central blind bore 161 of the rotating disk 16 and the passage 14*a* of the body 14 which leads to the water supply 5. The central blind bore 161, and so the radial slit 16*a* of the rotating disk 16, are thus in fluid communication with the water supply 5.

Between the angular positions P and Q, there are three other angular positions (not shown) so as to establish five equally pitched angular positions. When "HARD" washing is demanded by pressing the switch 65, the radial slot 16*a* of the rotating disk 16 takes one of these five angular positions, depending on the number of the illuminated lamps 88 which is selected using the switches 84 and 86. During washing, the water is supplied from the water supply 5 to the main passage 6 through the passage 14*a*, the central bore 154, the central bore 161, the radial slit 16*a*, and the first portion 151*a* of the first slit 151 which is overlapped with the radial slit 16*a* and which communicates with the passage 14*b*. Thus, water at a relatively high pressure is ejected through the main apertures 9 to the anus of the person (not shown) for washing the same. Since the overlapping area between the radial slit 16*a* and the first portion 151*a* of the first slit 151 varies for each angular position, changing or adjusting the number of the illuminated lamps 88 varies the intensity of the ejected water toward the anus.

Figure 6:
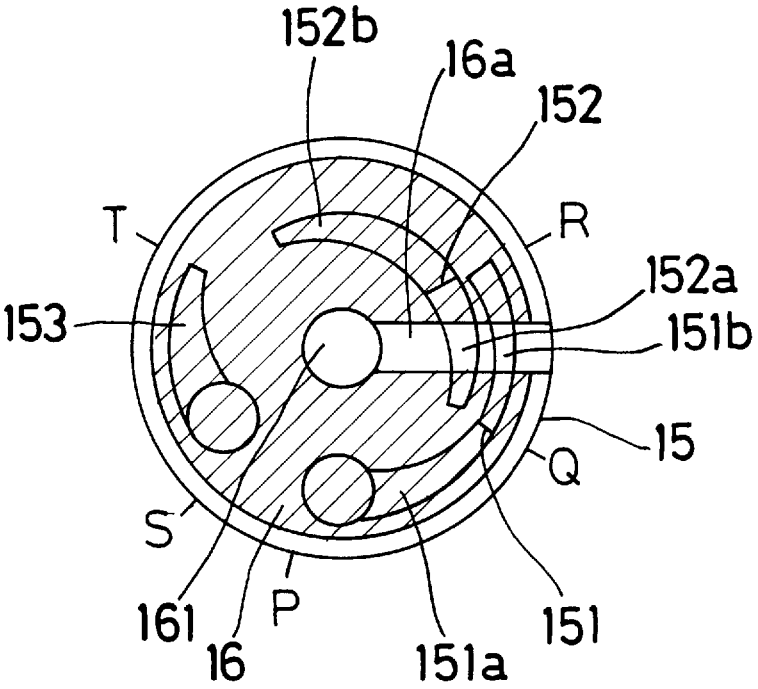
FIGS. 6 and 7 show different conditions of a rotating disk relative to stationary disk.

As shown in FIG. 6, between the angular positions Q and R, there are provided three other angular positions (not shown) so as to establish five equally pitched angular positions. When "SOFT" washing is demanded by pressing the switch 66, the radial slot 16*a* of the rotating disk 16 takes one of these five angular positions depending on the number of the illuminated lamps 88 which is selected using the switches 84 and 86. During washing, water is supplied from the water supply 5 to the main passage 6 through the passage 14*a*, the central bore 154, the central bore 161, the radial slit 16*a*, the second portion 151*b* of the first slit 151 which is overlapped with the radial slit 16*a* and the passage 14*b*. Concurrently, water is also supplied to the auxiliary passage 7 through the radial slit 16*a*, the second slit 152 which is overlapped with the radial slit 16*a* and the passage 14*c*. Thus, water at a relatively low pressure is ejected through the apertures 9 and 10 to the anus of the person for washing the same. Since the overlapping area between the radial slit 16*a* and the sum of the second slit 152 and the second portion 151*b* of the first slit 151 varies for each angular position, changing or adjusting the number of the illuminated lamps 88 varies the intensity of the ejected water toward the anus.

Figure 7:
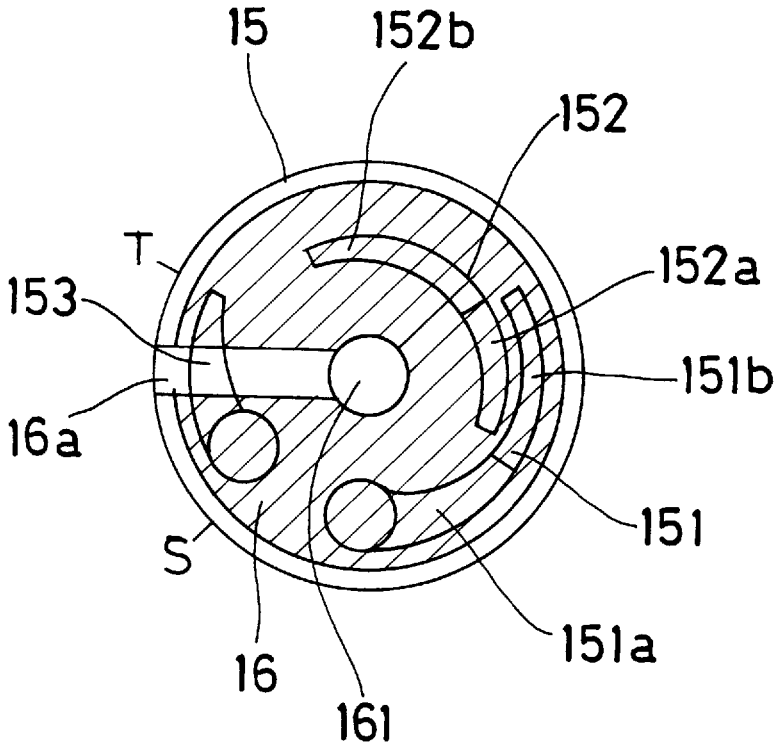

As shown in FIG. 7, between the angular positions S and T, there are provided three other angular positions (not shown) so as to establish five equally pitched angular positions. When "BIDET" washing is demanded by pressing the switch 67, the radial slot 16*a* of the rotating disk 16 takes one of these five angular positions depending on the number of the illuminated lamps 88 which is selected using the switches 84 and 86. During washing, water is supplied from the water supply 5 to the main passage 8 through the passage 14*a*, the central bore 154, the central bore 161, the radial slit 16*a*, the third slit 153 which is overlapped with the radial slit 16*a* and the passage 14*d*. Thus, water at a relatively high pressure is ejected through the apertures 12 to the pubic portion of the female person (not shown) for washing the same. Since the overlapping area between the radial slit 16*a* and the third slit 153 varies for each angular position, changing or adjusting the number of the illuminated lamps 88 varies the intensity of the ejected water toward the anus.

The invention has thus been shown and described with reference to a specific embodiment, however, it should be noted that the invention is in no way limited to the details of the illustrated structures but, changes and modifications may be made without departing from the scope of the appended claims.

What is claimed as new and is desired to be secured by Letters Patent of the United States is:

1. A sanitary device for washing a private part of a person sitting on a toilet bowl, comprising:

a nozzle positioned within the toilet bowl and having a main passage and an auxiliary passage, the main passage having at least one main aperture and the auxiliary passage having at least one auxiliary aperture, the main and auxiliary apertures being located at a distal end of said nozzle; and a regulating device fluidically disposed between a supply of water under pressure and both the main passage and the auxiliary passage for establishing a variable degree of fluid communication between the water supply and at least one of the main and auxiliary passages, wherein the regulating device includes a stationary disk and a rotating disk, the stationary disk having first and second slits connected to the main passage and the auxiliary passage, respectively, the rotating disk having a radial slit which overlaps with at least one of the first and second slits at certain angular positions of said rotating disk, wherein at least one of the radial slit and the first and second slits has a geometric characteristic causing an overlapped area of the radial slit with the respective first and second slits to vary with the certain angular position of said rotating disk, wherein said geometric characteristic comprises each of the first and second slits having a variable width, and wherein a portion of the first slit and a portion of the second slit concurrently overlap said radial slit of the rotating disk.

2. A sanitary device for washing private parts of a person sitting on a toilet bowl, comprising:

a first nozzle positioned within the toilet bowl and having a main passage and an auxiliary passage, the main passage having at least one main aperture and the auxiliary passage having at least one auxiliary aperture, the main and auxiliary apertures being located at a distal end of said first nozzle and being directed to a private part of a person sitting on the toilet bowl;

a second nozzle positioned within the toilet bowl and having a third passage, the third passage having at least one third aperture, the at least one third apertures being located at a distal end of said second nozzle and being directed to another private part of a person sitting on the toilet bowl; and a regulating device fluidically disposed between a supply of water under pressure and each of the main passage, the auxiliary passage and the third passage for establishing a variable degree of fluid communication between the water supply and at least one of the main, auxiliary and third passages, wherein the regulating device includes a stationary disk and a rotating disk, the stationary disk having first, second and third slits connected to the main passage, the auxiliary passage and the third passage, respectively, the rotating disk having a radial slit which overlaps with at least one of the first, second and third slits at certain angular positions of said rotating disk, wherein at least one of the radial slit and the first and second slits has a geometric characteristic causing an overlapped area of the radial slit with the respective first and second slits to vary with the certain angular position of said rotating disk, wherein said geometric characteristic comprises each of the first and second slits having a variable width, and wherein a portion of the first slit and a portion of the second slit concurrently overlap said radial slit of the rotating disk.

3. A sanitary device as set forth in claim 2, wherein the overlapped area of the radial slit with the respective first and second slits varies gradually with changes in the certain angular position.

* * * * *